US005312202A

United States Patent [19]

Newton

[11] Patent Number: 5,312,202

[45] Date of Patent: May 17, 1994

[54] ACCESS COVER ASSEMBLY

[75] Inventor: John R. Newton, Cumbria, United Kingdom

[73] Assignee: 3-D Composits LTD, Cumbria, United Kingdom

[21] Appl. No.: 951,201

[22] Filed: Sep. 25, 1992

[51] Int. Cl.[5] ..... E02D 29/14

[52] U.S. Cl. ..... 404/25; 52/20

[58] Field of Search ..... 404/25; 52/20

[56] References Cited

U.S. PATENT DOCUMENTS

| | | | |
|---|---|---|---|
| 3,046,853 | 7/1962 | Legendre | 404/25 |
| 4,015,373 | 4/1977 | Boissier | 52/20 |
| 4,456,397 | 6/1984 | Freis et al. | 404/25 |
| 4,499,695 | 2/1985 | Oger et al. | 52/19 |
| 4,662,777 | 5/1987 | Newton | 404/25 |
| 4,861,186 | 8/1989 | Ferns | 404/25 |

*Primary Examiner*—Mark Rosenbaum

*Assistant Examiner*—John M. Husar

*Attorney, Agent, or Firm*—Reising, Ethington, Barnard, Perry & Milton

[57] ABSTRACT

An access cover assembly (10) has a cover member (12) and a frame member (14). The cover member has twelve vertical wall sections (36) with adjoining vertical edges (38) and twelve canted surfaces (40) with adjoining angled edges (46) depending downwardly from said vertical wall sections (36). The frame member has an upwardly facing frusto-conical section (80) and a number of substantially vertical edges (82) depending downwardly from an inner periphery (81) of said section (80), said inner periphery (81) being shaped such that when said angled edges (46) engage said inner periphery (81) when the cover is partially seated in the frame, the cover rotates towards a fully seated position in the frame member (14), whereupon the cover falls into and is locked within the frame member.

11 Claims, 6 Drawing Sheets

ACCESS COVER ASSEMBLY

TECHNICAL FIELD

The field of this invention relates to access cover assemblies for below ground utilities and the like.

BACKGROUND OF THE DISCLOSURE

Man hole covers for underground utilities, underground storage tanks, and sewer lines have generally been make from iron or steel to provide sufficient strength for supporting vehicular traffic and pedestrian traffic. Access covers which are subject to vehicular traffic must also be capable or resisting the horizontal forces imposed on the covers by motor vehicles, either during acceleration or during braking on the cover. These horizontal forces can be substantial. Square or rectangular covers inherently resist rotation when seated in a complementary shaped frame seat. However, if a square or rectangular cover becomes dislodged from the frame seat, there is a danger that the cover can fall through and into the hole, making retrieval of the cover difficult.

A round cover has the inherent advantage of not being able to fall through the circular aperture in the frame underneath. The disadvantage of a round cover is that the round shape does not inherently prevent rotation of the cover within the frame member. Consequently, an anti-rotation feature, i.e locking device, must be introduced into the cover and frame assembly. Known locking devices require precise rotational alignment of the round cover with respect to the frame member. Larger covers are difficult to maneuver and precise alignment to properly seat the cover is difficult to achieve.

Efforts have been made to lighten man hole covers by replacing steel and iron covers with composite covers that have skins of glass reinforced plastic material and a poly-urethane interior. Such covers are described in my U.S. Pat. No. 4,662,777 and such molding techniques taught therein are incorporated by reference. Man hole covers made of composite materials may still have significant weight and size that makes maneuverability difficult.

What is needed is an access cover and frame assembly that provides for a round cover to be automatically rotationally aligned as the cover is slid into place over the frame member.

SUMMARY OF THE DISCLOSURE

In accordance with one aspect of the invention, an access cover assembly has a cover member and an annular frame member. The cover member has a substantially circular outer peripheral edge with a central axis extending transverse to the plane containing the peripheral edge. The cover member has a plurality of downwardly facing flat surfaces with adjoining angled edges, these surfaces being circumferentially spaced about a center vertical axis of the cover with the flat surfaces being canted such that a respective inner peripheral edge of a respective flat surface is positioned below a respective outer peripheral edge thereof. A respective substantially vertical and flat wall section extends upwardly from a respective outer peripheral edge of each canted flat surface. A downwardly facing frusto-conical section extends radially outwardly and upwardly from a top edge of the vertical wall sections.

The frame member has a center aperture and an upwardly facing frusto-conical surface about the center aperture the extends outwardly and upwardly. The frame member has wall sections extending downwardly from an inner periphery of said upwardly facing frusto-conical section and positioned to allow said vertical wall sections of said cover member to be received within said center aperture at predetermined rotated positions about the frame's central axis. The inner periphery of the frusto-conical section is shaped such that when the angled edges of the cover engage said shaped inner periphery, such as occurs when the cover is placed in the frame in a partially seated position, the cover rotates with respect to the frame member toward one of the predetermined rotated positions wherein the cover member drops into and is seated in the frame member and locked against further relative rotation with respect to the frame member.

According to a broader aspect of the invention, the cover member has a substantially circular outer peripheral rim section with a central axis extending transverse to the plane containing the peripheral rim section. A first series of downwardly depending edges are circumferentially spaced about the central vertical axis and positioned radially inward from an outer periphery of said rim section. A second series of downwardly depending edges circumferentially spaced about said central vertical axis and canted radially inwardly and downwardly from a lower edge of said respective first series of downwardly depending sections. The frame member has a center aperture and an upwardly facing surface about said center aperture.

The frame member has wall sections extending downwardly from an inner periphery of said upwardly facing surface and positioned to allow said first and second series of downwardly depending edges to be received within said center aperture at predetermined rotated positions about said central axis. The inner periphery of said upwardly facing surface being shaped such that upon engagement of the second series of edges of the cover member with the inner periphery of the frame member, such as occurs when the cover member is placed in the frame member in a position other than one of said predetermined positions, the cover rotates with respect to the frame member toward one of said predetermined rotated positions wherein the cover member drops into and is seated in the frame member and locked against relative rotation with respect to the frame member.

Preferably, the first series of downwardly depending edges are side edges of substantially vertical wall sections of the cover member positioned radially within and below said outer periphery of the rim section. The second series of downwardly depending edges are edges of surface which are canted radially inwardly and downwardly from a lower edge of said respective vertical wall sections.

In accordance with another aspect of the invention, a cover member has a substantially circular outer peripheral edge with a central axis extending transverse to the plane containing the peripheral edge. The frame member has a center aperture, with an upwardly and outwardly facing annular surface about said center aperture. The frame and cover member are constructed such that the cover can be seated in said frame member in a plurality of predetermined rotated positions. The frame and cover member are also constructed such that when cover is partially seated in said frame member, said cover rotates with respect to said frame member toward one of the predetermined rotated positions wherein said cover member drops into and is fully seated in said frame member and locked against further relative rotation with respect to said frame member.

BRIEF DESCRIPTION OF THE DRAWINGS

Reference now is made to the accompanying drawings in which.

DETAILED DESCRIPTION OF THE PREFERRED EMBODIMENT

Figure 1:
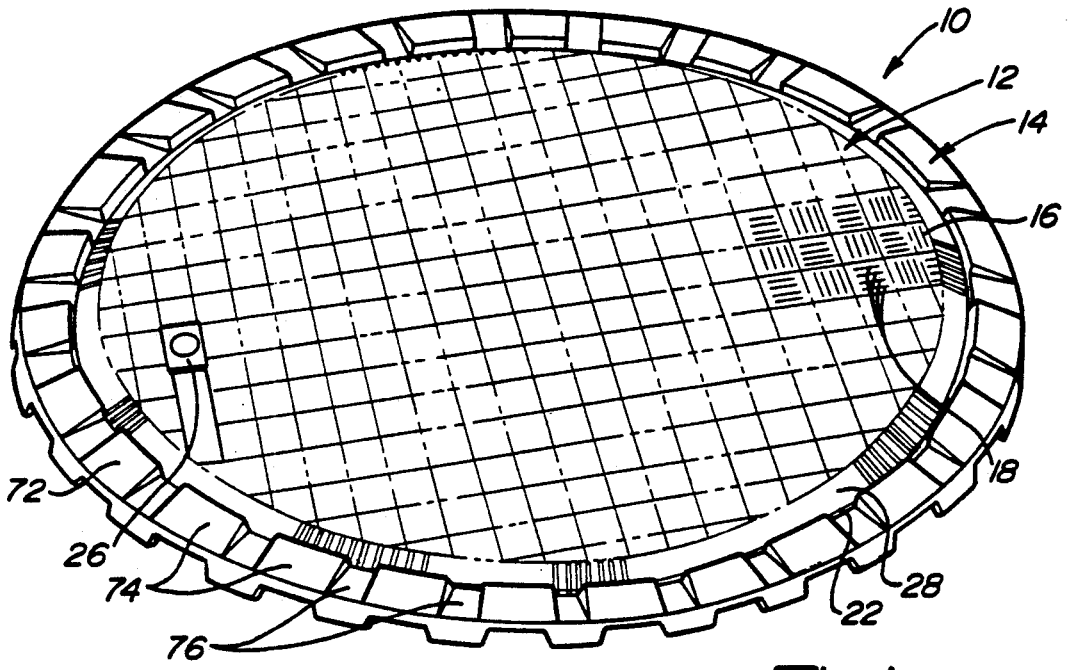
FIG. 1 is a perspective view of a utility access cover assembly according to one embodiment of the invention.
Figure 4:
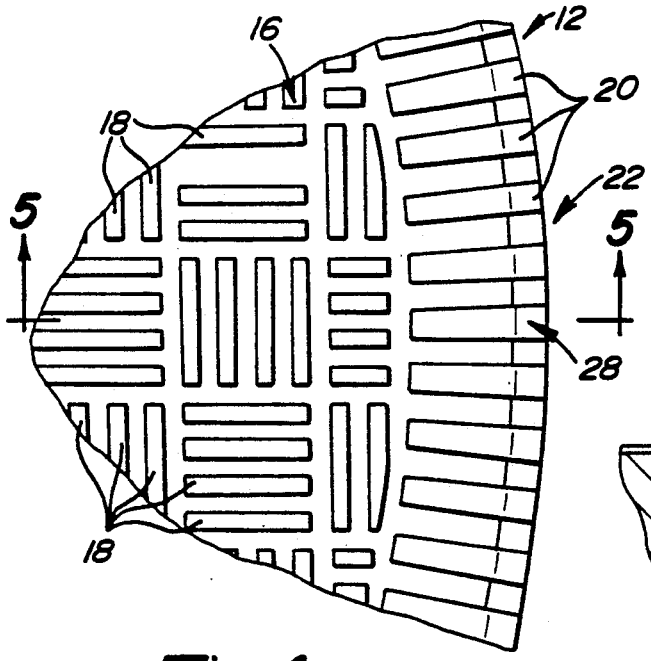
FIG. 4 is an enlarged fragmentary top plan view of the access cover shown in FIG. 2.
Figure 2:
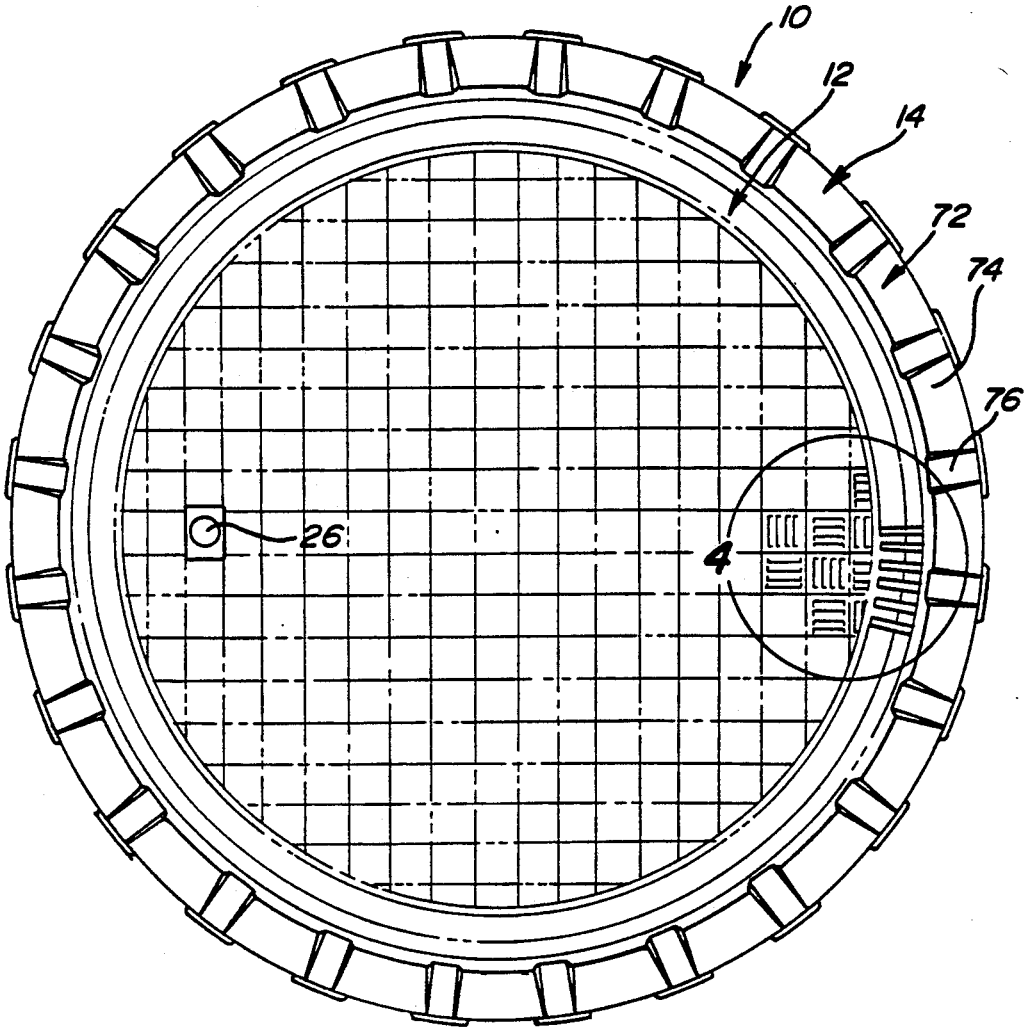
FIG. 2 is a top plan view thereof.
Figure 6:
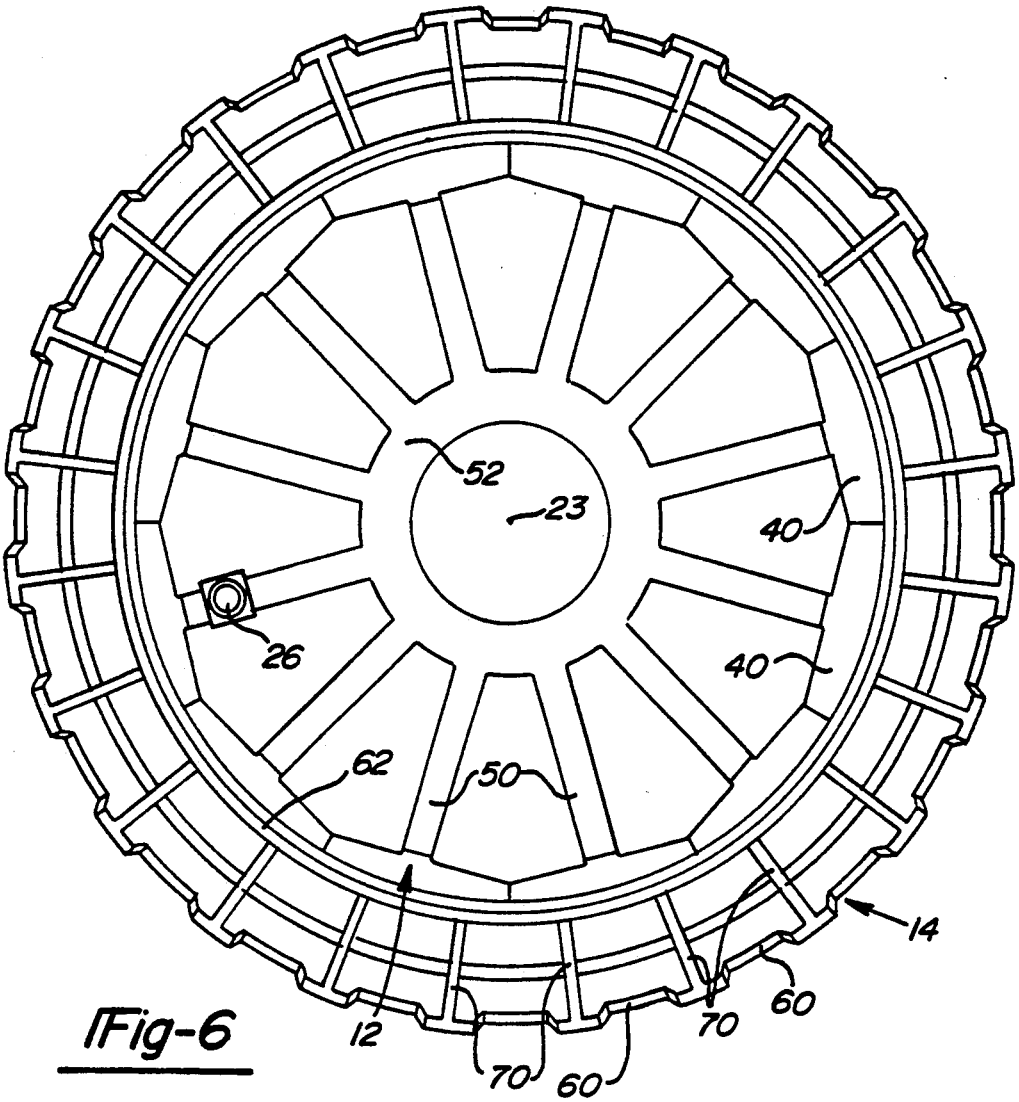
FIG. 6 is bottom plan view of the access cover assembly shown in FIG. 1.

Referring now to FIGS. 1 and 2, a cover assembly 10 includes a cover member 12 and a frame member 14. The cover 12 has an upper surface 16 that has a plurality of ribs 18. As shown in FIG. 4, the ribs may form a rectangular pattern. Outer ribs 20 may be positioned along the outer peripheral edge 22 of cover 12. The cover may have a keyhole 26 that may receive a tool to facilitate lifting of the cover.

Figure 5:
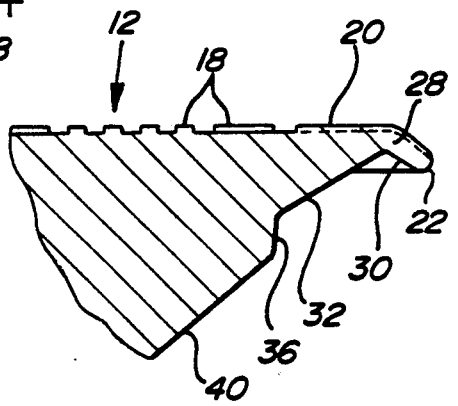
FIG. 5 is a cross-sectional view taken along line 5—5 shown in FIG. 4.

The outer peripheral edge 22 has a circular shape lying in a plane that is substantially perpendicular to central axis 23 Adjacent the outer peripheral edge 22 is a radially outwardly and downwardly extending annular lip portion 28 as illustrated in FIG. 5 with a lower surface 30 that is joined at its inner periphery to a frusto-conical seating surface 32.

Figure 7:
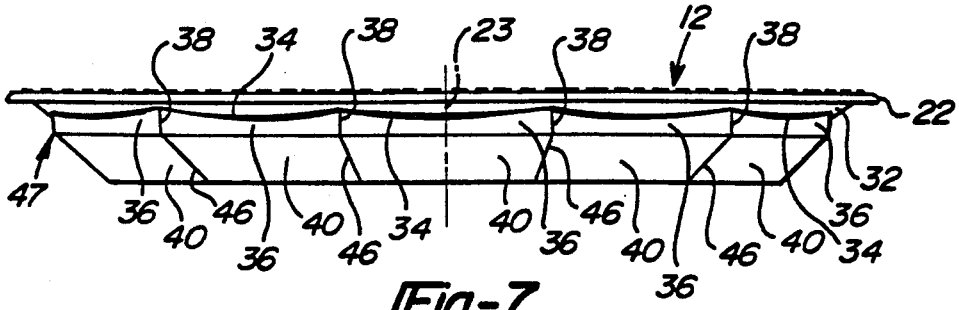
FIG. 7 is a side elevational view of the access cover shown in FIG. 1.
Figure 8:
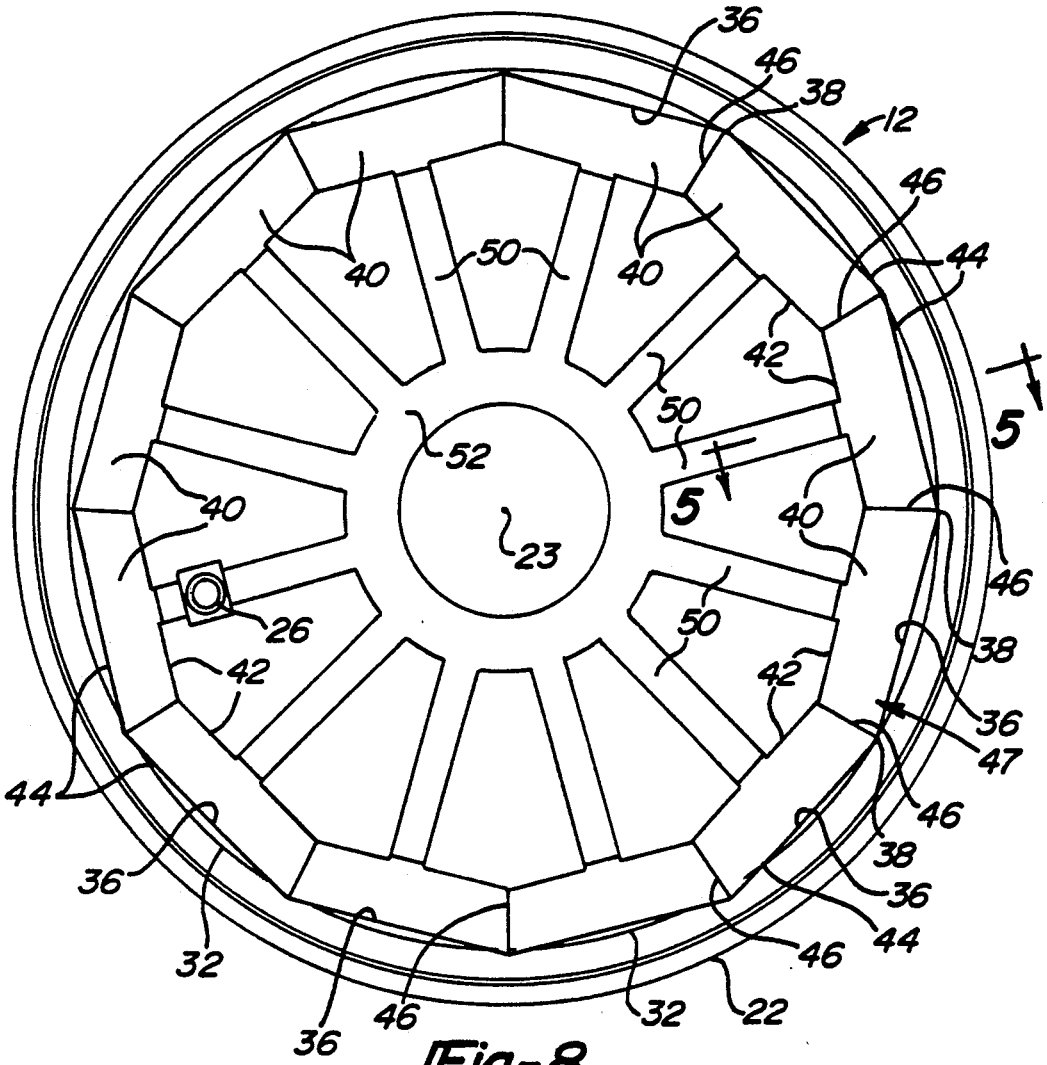
FIG. 8 is bottom plan view of the access cover shown in FIG. 1.

As shown in FIGS. 7 and 8, the inner periphery of the seating surface 32 abut twelve circumferentially spaced substantially vertical wall sections 36 to form a scalloped edging 34 therebetween. Each of the vertical wall sections 36 are equally spaced from the center axis 23 and abut each other at adjoining vertical edges 38 to form a regular polygonal shape. Each of the vertical wall sections 36 are circumferentially aligned with a respective canted lower wall section 40 that is canted radially upwardly and outwardly with respect to central axis 23 from inner edge 42 to outer edge 44. Outer edge 44 is also a lower edge of vertical wall section 36. Each canted wall section 40 adjoins another wall section at common angled edges 46 to form a lower rim section 47.

Raised skids 50 extend inwardly from inner edge 42 to an inner annular ring 52, the purpose of these being to provide a wear surface if the cover is dragged along the ground. The cover 12 may be made from a composite plastic material. The composite plastic material may be a sandwich type construction as taught in my U.S. Pat. No. 4,662,777 which is incorporated herein by reference. Any other type of plastic mold construction or conventional metals such as steel or iron is also suitable.

Figure 3:
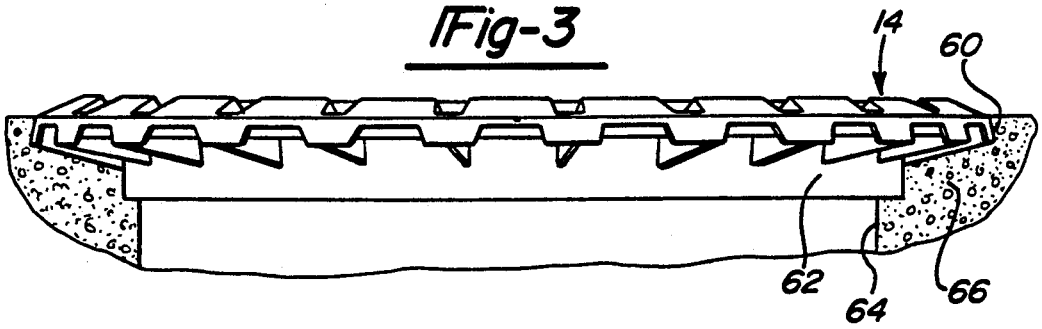
FIG. 3 is a side elevational view thereof.
Figure 10:
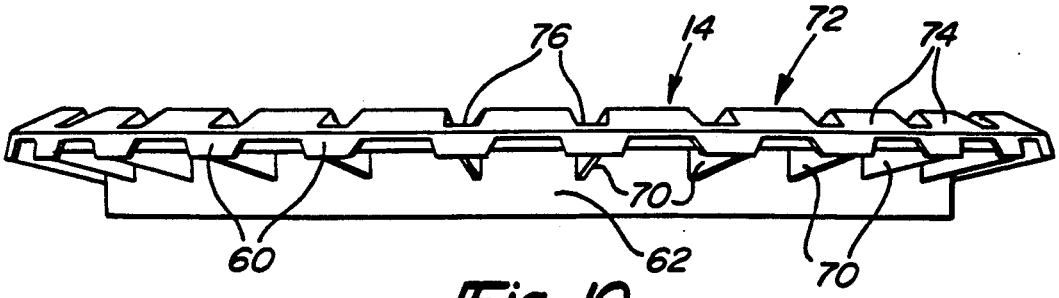
FIG. 10 is side elevational view of the access cover seat shown in FIG. 9.
Figure 9:
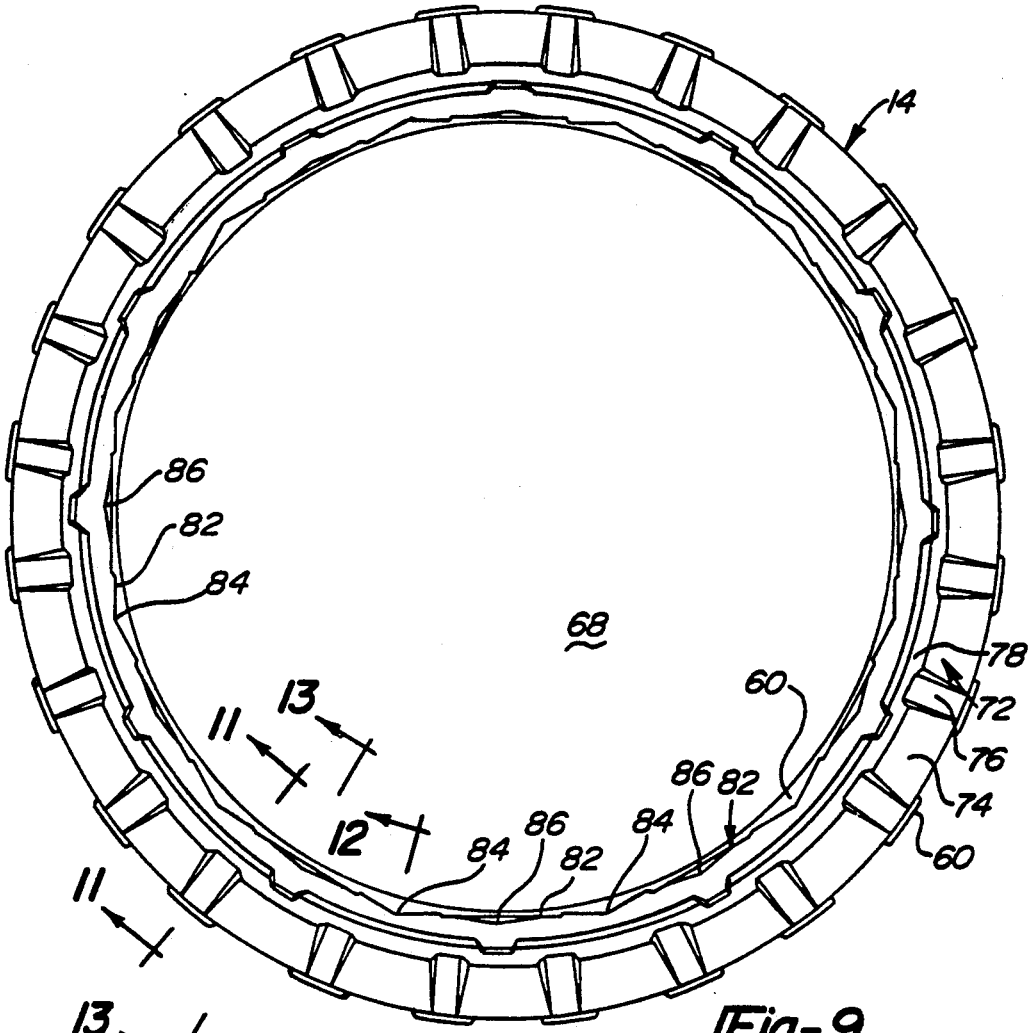
FIG. 9 is a top plan view of the access cover seat shown in FIG. 1.
Figure 11:
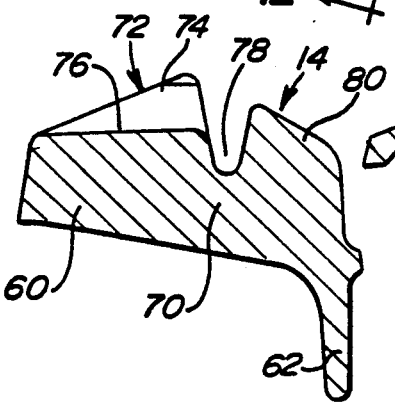
FIG. 11 is a cross-sectional view taken along line 11—11 shown in FIG. 10.
Figure 12:
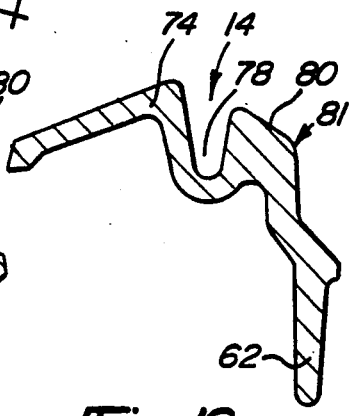
FIG. 12 is a cross-sectional view taken along line 12—12 shown in FIG. 10.

As shown in FIGS. 3 and 10, the frame member 14 has a downwardly extending peripheral rim section 60 and an annular inner neck portion 62 that extend downwardly into a hole 64 in a load supporting substrate 16 such as asphalt or cement. The frame may be fabricated from iron or steel to provide surfaces that have comparably low friction coefficients when compared to cement or other rougher construction materials conventionally used to make manhole frame members. As shown in FIG. 9, the frame member 14 has a central aperture 68 within neck portion 62. A plurality of structural ribs 70 radially extend between neck portion 62 and rim section 60. If desired, these ribs 70 may be omitted. Situated above the ribs is an annular sloped and notched upper ring section 72 with a plurality of circumferentially spaced protrusions 74 and intervening notches 76. The ring section 72 functions as a snow plow guard. An annular groove 78 is radially positioned inwardly from upper ring section 72 and is sized to receive lip section 28 of cover 12. The groove 78 connects to grooves 76 which allows drainage of water from groove 78. A frusto-conical upwardly facing surface 80 is radially positioned inwardly from groove 78. The frusto-conical surface 80 is sized and canted to seat downwardly facing surface 32 of cover 12 when the cover 12 is fully seated into frame 14.

Figure 13:
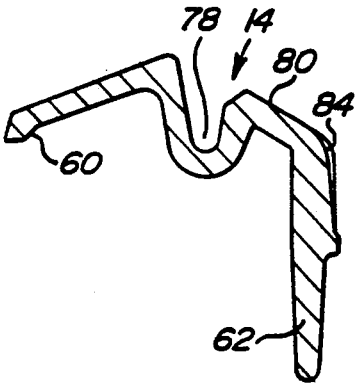
FIG. 13 is a cross-sectional view taken along line 13—13 shown in FIG. 10.
Figure 14:
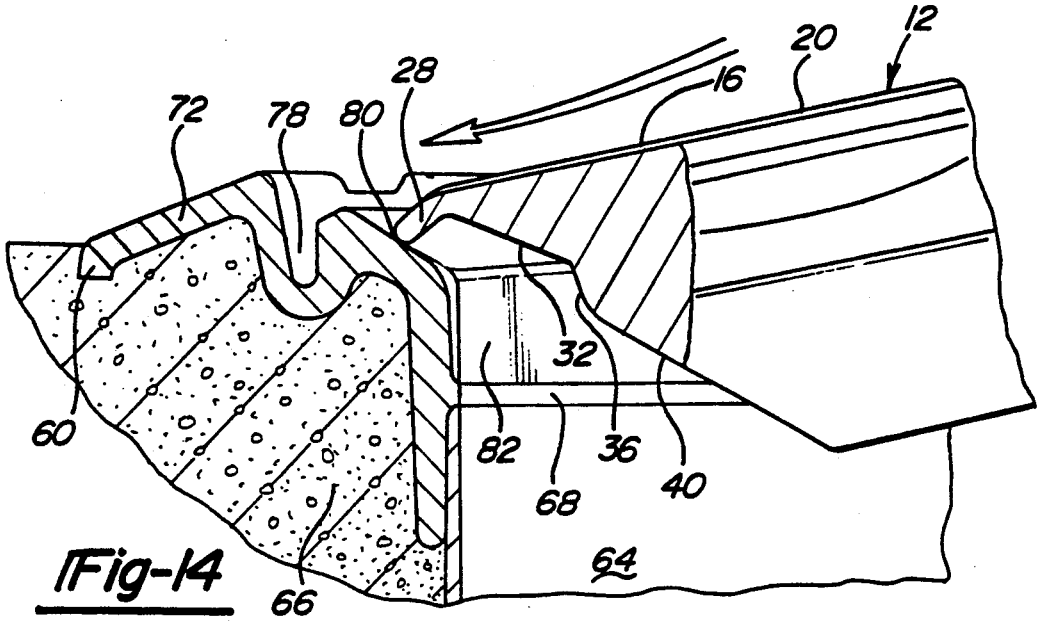
FIG. 14 is a fragmentary and segmented view of the cover assembly illustrating the seating of the cover into the frame.
Figure 16:
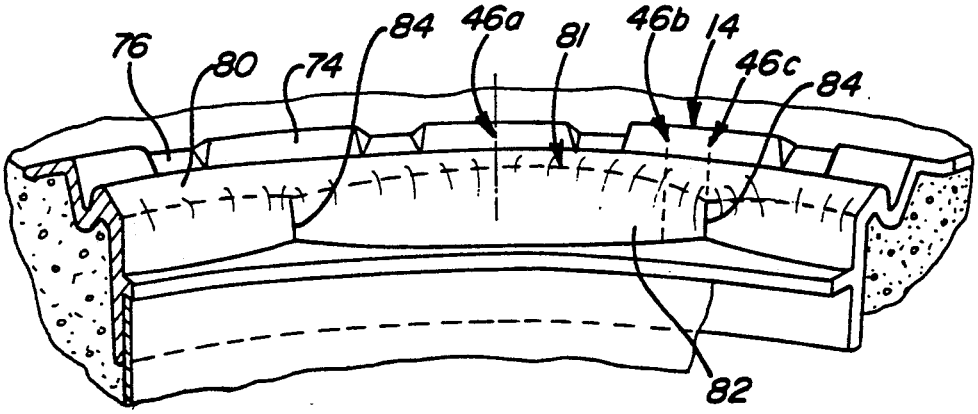
FIG. 16 is a fragmentary interior perspective view of the frame member.

Extending downwardly from the inner periphery of the frusto-conical surface 80 are twelve substantially vertical wall sections 82. The wall sections 82 are circumferentially spaced about the central axis 23 and form a generally polygonal contour about central hole 68 that is sized to receive the polygonal shaped wall sections 36 of cover member 12. The wall section 82 has a height greater than the vertical wall sections 36 of cover member 12. As best illustrated in FIGS. 9, 13 and 16, the wall sections 82 are joined at radially outward recesses 84. The junction between each wall section 82 and its respective adjacent part of the frusto-conical surface 80 is a radiused edge 81, the radius of curvature of which changes smoothly from its largest value, typically 20 rad (radius in millimeters) in the center 86 of the wall section 82 to its smallest value, typically 8 rad, at each outward recess 84.

Figure 15:
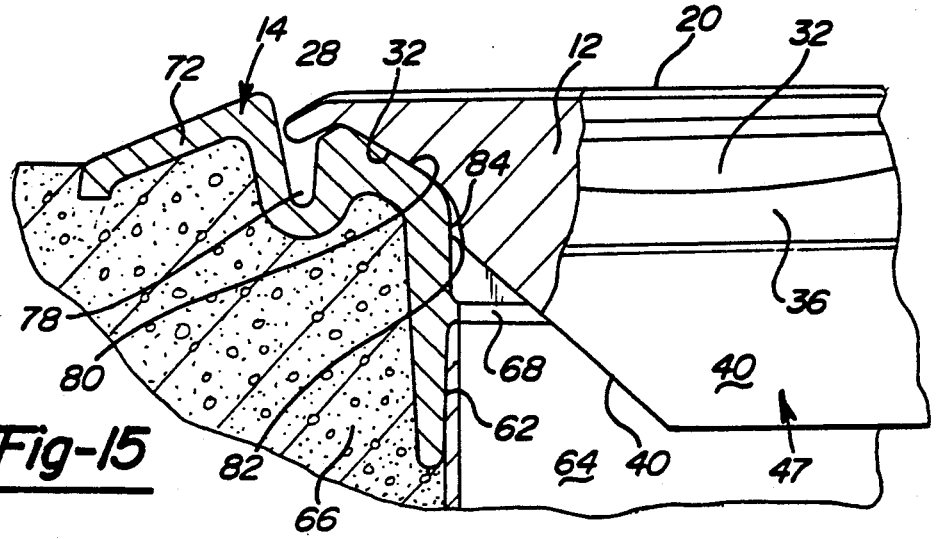
FIG. 15 is a fragmented and segmented view of the cover assembly shown in FIG. 1.

As illustrated in FIG. 15, the cover member 12 when fully seated in frame member 14 has its vertical walls 36 adjacent to the substantially vertical walls 82 of the frame member and the two frusto conical surfaces 32 and 80 abut each other. The lip 28 extends partially into groove 78. The proximity of the vertical walls 82 and 36 locks the cover 12 into the frame member 14 and prevents any substantial rotation of the cover 12 with respect to the frame member 14.

The cover 12 may be lifted from the frame 14 when access to hole 64 is required by use of a key tool not shown inserted into key hole 26 and upwardly pulled.

Reseating of the cover 12 into the frame member 14 is accomplished by sliding the cover 12 over the frame member 14 in a position approximately to the fully seated position. In this position, each of the angled edges 46 between the canted wall sections 40 of the cover member contact a respective radiused edge 81 of the frame at a point indicated by line **46*b* in FIG. 16. The slope of each angled edge 46 and the weight of cover 12 coupled with the fact that the distance of edge 81 from the central axis 23 is greater into the corner recesses 84 than it is across the wall sections 40 results in a small torque which acts on the cover 12 causing it to rotate as each angled edge 46 slides along radiused edge 81 towards its nearest corner recess 84, as indicated by line 46*c*. Thus the cover 12 rotates and falls vertically as it approaches the fully seated position. Once the angled edges 46 are aligned exactly with the corner recesses 84, the cover 12** stops rotating and drops vertically into the locked, fully seated position.

When in this locked position, the engagement of the edges 38 with corner recesses 84 prevents any horizontal force which may be applied to the cover, e.g., by a vehicle's wheel spinning on the cover, from rotating the cover 12 within frame 14.

As has been described previously, the cover 12 self aligns with the frame member provided the cover 12 first placed in the frame member in a position approximating to the correctly aligned position. Because the frame member and cover member are divided into twelve sections, the cover locks into the frame every 30° and if the cover is initially placed in the frame exactly 15° from the correctly aligned position, each angled edge 46 will sit in an equilibrium position **46*a* the highest point of the radiused edge 81, and the operator in this instance would have to apply a rotational force, for example, by means of the tool in the keyhole 26**, to initiate the self-aligning action. On the other hand, if the initial position of the cover is less than 15° from the correctly aligned position, then no force need be applied by the operator and the cover will simply rotate and fall slightly as it approaches the correctly aligned position, finally dropping into the locked position.

The composite plastic material and the steel material of the respective cover and frame members provides sufficiently low friction coefficients to allow the self guiding feature of the cover to effectively work.

Variations and modifications are possible without departing from the scope and spirit of the present invention as defined by the appended claims.

The embodiments in which an exclusive property or privilege is claimed are defined as follows:

1. An access cover assembly having a cover member and an annular frame member, said assembly characterized by;

said cover member having a substantially circular outer peripheral edge with a central axis extending transverse to the plane containing the peripheral edge;

said cover member having a plurality of downwardly facing flat surfaces circumferentially spaced about a center vertical axis of said cover with said flat surfaces being canted such that a respective inner peripheral edge of a respective surface is positioned below a respective outer peripheral edge of said respective surface, each of said canted flat surfaces adjoining another canted flat surface at an angled edge;

a respective substantially vertical and flat wall section extending upwardly from a respective outer peripheral edge of each canted flat surface;

said frame member having a center aperture and an upwardly facing frusto-conical surface about said center aperture which extends outwardly and upwardly;

said frame member having a plurality of substantially vertical and flat wall sections extending downwardly from an inner periphery of said upwardly facing frusto-conical section and positioned to allow said vertical and flat wall sections of said cover member to be locked within said center aperture at predetermined rotated positions about said central axis; and said inner periphery of said upwardly facing frusto-conical section being shaped such that upon engagement of the angled edges of the cover member with said inner periphery, such as occurs when the cover member is placed in the frame member in a position other than one of said predetermined positions, the cover rotates towards one of said predetermined positions wherein said cover member drops into and is fully seated in said frame member and locked against further relative rotation with respect to said frame member.

2. An access cover assembly having a cover member and an annular frame member, said assembly characterized by;

said cover member having a substantially circular outer peripheral rim section with a central axis extending transverse to the plane containing the peripheral rim section;

a first series of downwardly depending edges being circumferentially spaced about said central vertical axis and radially inward from an outer periphery of said rim section;

a second series of downwardly depending edges circumferentially spaced about said central vertical axis and canted radially inwardly and downwardly from a lower edge of said respective first series of downwardly depending edges;

said frame member having a center aperture and an upwardly facing surface about said center aperture;

said frame member having wall sections extending downwardly from an inner periphery of said upwardly facing surface and positioned to allow said first and second series of downwardly depending edges to be received within said center aperture at predetermined rotated positions about said central axis; and said inner periphery of said upwardly facing surface being shaped such that upon engagement of said second series of edges of the cover member with said inner periphery of the frame member, such as occurs when the cover member is placed in the frame member in a position other than one of said predetermined positions, the cover rotates towards one of said predetermined rotated positions wherein said cover member drops into and is seated in said frame member and locked against further relative rotation with respect to said frame member.

3. An access cover assembly as defined in claim 2 further characterized by:

said first series of downwardly depending edges being side edges of substantially vertical wall sections of said cover member positioned radially within and below said outer periphery of said rim section.

4. An access cover assembly as defined in claim 3 further characterized by:

said substantially vertical wall sections of said cover member being substantially flat.

5. An access cover assembly as defined in claim 3 further characterized by:

said second series of downwardly depending edges being side edges of surfaces which are canted radially inwardly and downwardly from a lower edge of said respective vertical wall sections.

6. An access cover assembly as defined in claim 5 further characterized by:

said canted surfaces or said cover member being substantially flat.

7. A cover member for an access cover assembly, said cover member characterized by:

a substantially circular outer peripheral edge with a central axis extending transverse to the plane containing the peripheral edge;

a plurality of downwardly facing flat surfaces circumferentially spaced about a center vertical axis of said cover with said flat surfaces being canted such that a respective inner peripheral edge of a respective surface is positioned below a respective outer peripheral edge of said respective surface;

a respective substantially vertical and flat wall section extending upwardly from a respective outer peripheral edge of each canted flat surface;

a downwardly facing frusto-conical section extending radially outwardly and upwardly from a top edge of said vertical wall sections; and said outer peripheral rim section including a downwardly and radially outwardly extending lip.

8. A frame member for an access cover assembly, said frame member characterized by:

a center aperture and an upwardly facing frusto-conical surface about said center aperture and extending outwardly and upwardly;

a plurality of wall sections extending downwardly from an inner periphery of said upwardly facing frusto-conical section and positioned to allow said vertical wall sections of said cover member to be received within said center aperture at predetermined rotated positions about said central axis; and said inner periphery of said upwardly facing frusto-conical surface being shaped such that upon engagement of said angled edges of said cover member with said inner periphery, such as occurs when the cover member is placed in the frame member in a position other than one of said predetermined positions, the cover rotates towards one of said predetermined rotated positions wherein said cover member drops into and is seated in said frame member and locked against relative rotation with respect to said frame member.

9. A frame member for an access cover assembly as defined in claim 8 further characterized by:

a recessed annular seating area situated about said frusto-conical section; and a radially outer and raised ridge section having a plurality of notches therein for providing access of a lifting tool to a lip section of a cover member positioned in said recessed annular seating area.

10. An access cover assembly having a cover member and an annular frame member, said assembly characterized by:

said cover member having a substantially circular outer peripheral edge with a central axis extending transverse to the plane containing the peripheral edge;

said frame member having a center aperture and an upwardly facing annular surface about said center aperture and extending outwardly and upwardly;

vertical locking means for seating said cover and locking said cover in a plurality of predetermined rotated positions;

guidance means for causing said cover member to selectively rotate in both clockwise and counter-clockwise towards one of said predetermined rotated positions;

said cover member having first means downwardly depending from and radially positioned inwardly from said outer peripheral edge section for engagement, when in one of said predetermined rotated positions, with said vertically extending means of said frame member; and second means depending downwardly from and radially positioned inwardly from said first means for sliding engagement with said guidance means of the frame member whereby the cover member rotates selectively clockwise and counter-clockwise towards one of said predetermined rotated positions wherein said cover member, when in one of said predetermined rotated positions, ceases to rotate and drops vertically into and is seated in said frame member and locked against relative rotation with respect to said frame member.

11. An access cover assembly having a cover member and an annular frame member, said assembly characterized by:

said cover member having a substantially circular outer peripheral edge with a central axis extending transverse to the place containing the peripheral edge;

said frame member having a center aperture, an upwardly facing annular surface about said center aperture, and engagement means for seating said cover and locking said cover in a plurality of predetermined rotated positions;

said cover and frame ember having complementary guidance means for rotating said cover with respect to said frame member such that when said cover is partially seated in said frame member said cover rotates selectively clockwise and counter-clockwise towards one of said plurality of predetermined rotated positions and, when in one of said plurality of predetermined rotated positions, said cover member ceases to rotate and drops vertically into and is fully seated in said frame member and locked against further relative rotation with respect to said frame member.

* * * * *